US006466191B1

(12) United States Patent
Choi et al.

(10) Patent No.: US 6,466,191 B1
(45) Date of Patent: Oct. 15, 2002

(54) LIQUID CRYSTAL DISPLAY THIN FILM TRANSISTOR DRIVING CIRCUIT

(75) Inventors: Jae-Jin Choi; Seung-Hwan Moon, both of Seoul; Jung-Hwan Kim, Kyungki-do, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/459,924

(22) Filed: Dec. 14, 1999

(30) Foreign Application Priority Data

Dec. 24, 1998 (KR) ..... 98-58169

(51) Int. Cl.[7] ..... G09G 3/36
(52) U.S. Cl. ..... 345/94; 345/87
(58) Field of Search ..... 345/94, 95, 98, 345/89, 99

(56) References Cited

U.S. PATENT DOCUMENTS 5,301,047 A * 4/1994 Hoshino et al. ..... 359/55
5,670,973 A * 9/1997 Bassetti, Jr. et al. ..... 345/58
5,691,739 A * 11/1997 Kawamori et al. ..... 345/58
5,760,757 A * 6/1998 Tanaka et al. ..... 345/93
5,926,157 A * 7/1999 Moon ..... 345/89
6,057,819 A * 5/2000 Sone et al. ..... 345/96

FOREIGN PATENT DOCUMENTS

JP 4-22923 1/1992

* cited by examiner

*Primary Examiner*—Vijay Shankar
*Assistant Examiner*—Nitin Patel
(74) *Attorney, Agent, or Firm*—McGuireWoods LLP; Hae-Chan Park

(57) ABSTRACT

A liquid crystal display of the present invention comprises a panel on which are formed a plurality of thin film transistors, a plurality of gate lines connected to gate electrodes of the thin film transistors, a plurality of data lines connected to source lines of the thin film transistors, a gate driver that applies a gate signal to the gate lines of the panel, a data voltage generator that generates data voltages which has many voltage levels, a data driver that applies to the data lines a data voltage for displaying picture signals on the liquid crystal display, a common electrode voltage generator that generates a common electrode voltage applied to a common electrode of the panel, a compensator for a distortion of common electrode voltage that is connected between the panel and the data voltage generator and compensates for the distortion of common electrode voltage by changing the data voltage. The crosstalk phenomenon of the LCD can be decreased in accordance with the present invention.

10 Claims, 6 Drawing Sheets

| | | | | | | | | |
|---|---|---|---|---|---|---|---|---|
| + | − | + | − | + | − | + | − | + |
| − | + | − | + | − | + | − | + | − |
| + | − | + | − | + | − | + | − | + |
| − | + | − | + | − | + | − | + | − |
| + | − | + | − | + | − | + | − | + |
| − | + | − | + | − | + | − | + | − |

LIQUID CRYSTAL DISPLAY THIN FILM TRANSISTOR DRIVING CIRCUIT

BACKGROUND OF THE INVENTION (a) Field of the Invention

The present invention relates to a liquid crystal display (LCD), and more particularly to a driving circuit of a thin film transistor(TFT) LCD that compensates for the distortion of a common electrode voltage applied to a liquid crystal capacitor of each unit pixel in the LCD.

(b) Description of the Related Art

An LCD, which is one type of flat panel displays, uses the characteristic of the liquid crystal layers that can change the transmittance of light in accordance with a voltage applied thereto. An LCD has an advantage of being able to be driven at a lower voltage consuming little power. Such advantages have contributed to the widespread use of the LCD.

In an LCD, however, signal interferences between pixels deteriorates the display quality.

Such a deterioration of display quality in the conventional TFT-LCD will now be explained hereinafter with reference to the drawings.

FIG. 1 shows an equivalent circuit of a unit pixel in the conventional LCD.

As shown in FIG. 1, formed in the LCD are a liquid crystal capacitor Clc, which is formed by a pixel electrode 30, a common electrode 40 and liquid crystal injected between the pixel electrode 30 and a common electrode 40, and a TFT serving as switch that applies to the pixel electrode 30 a pixel voltage coming through a data line 10, controlled by the gate signal coming through a gate line 20. A storage capacitor may be formed in parallel with the liquid crystal capacitor Clc to improve the LCD's ability to store charges.

Common electrode voltage Vcom applied to the common electrode 40 may be distorted because of the state of image signals applied to the LCD panel. The common electrode voltage is distorted mainly due to the following factors: a parasitic capacitor Cdc formed between the data line 10 and the common electrode 40; and the characteristic of liquid crystal display Clc of which capacitance changes in accordance with the magnitude of voltage applied to the liquid crystal.

Such a distortion of the common electrode voltage Vcom changes the magnitude of the voltage actually applied to both terminals of the liquid crystal capacitance Clc, the difference between the gray voltage and the common electrode voltage Vcom, thereby inducing a crosstalk phenomenon that deteriorates the display quality of contiguous pixels.

Such a crosstalk as caused by the distortion of the common electrode voltage develops also in the LCD employing a dot inversion driving method, which is intended to minimize the occurrence of crosstalk.

The distortion of the common electrode voltage in the LCD using the dot inversion driving method will be explained hereinafter with reference to drawings.

FIG. 2 shows a charged voltage of each unit pixel in the LCD using the dot inversion driving method.

FIG. 3 shows a schematic view of a gray voltage generating circuit in the conventional TFT-LCD driving circuit using a resistor string.

In the dot inversion driving method, a voltage of opposite polarity are applied to contiguous pixels of the LCD, and the voltage applied to the each unit pixel at each frame is the inverted voltage of the previous frame. A plus voltage is applied to the liquid crystal when applying gray voltage higher than the common electrode voltage to the liquid crystal capacitor Clc, and a minus voltage is applied to the liquid crystal when applying gray voltage lower than the common electrode voltage to the liquid crystal capacitor Clc. As shown in FIG. 2, voltages of opposite polarities are applied to the liquid crystal capacitor Clc of contiguous pixels. In more detail, as shown in FIG. 3, if the common electrode voltage Vcom of the gray voltage generating circuit is Va/2, the gray voltage lower than Va/2 (VG1, VG2) is applied to make the charged voltage in the liquid crystal capacitor minus and the gray voltage higher than Va/2 (VG3, VG4) is applied to make the charged voltage in the liquid crystal capacitor plus.

FIG. 4 shows a schematic view of the common electrode voltage and the gray voltage applied to the LCD when no crosstalk phenomenon occurs in the dot inversion driving method.

FIG. 5 shows the common electrode voltage and the data voltage applied to the LCD when the crosstalk phenomenon occurs in the dot inversion driving method.

As shown in FIG. 4, the gray voltage generating circuit in the LCD utilizing the dot inversion driving method applies a voltage lower than the common electrode voltage and a voltage higher than the common electrode voltage alternately to protect the liquid crystal layer against degrading, although the same color may be displayed on the LCD. Here, 1H in FIG. 4 refers to a period for which the gate line is turned on, When the voltages charged in the liquid crystal in the horizontal direction of the LCD are (+), (−), (+), (−), . . . and displayed colors in the horizontal direction of the LCD are B(black), W(white), B, W . . . or W, B, W, B, . . . , the crosstalk phenomenon occurs.

In a TFT-LCD, an electric field caused by the voltage difference between the common electrode voltage Vcom and the gray voltage applied through the TFT is applied to the liquid crystal capacitor Clc, and the luminance and the transmittance of the liquid crystal layer are determined by the intensity of the electric field applied to the liquid crystal capacitor Clc. In the normally white mode LCD, when the difference of the voltage applied to both terminals of the liquid crystal capacitor is minimum, the LCD displays white, and when the difference of the voltage applied to both terminals of the liquid crystal capacitor is maximum, the LCD displays black. Accordingly, when white appears on the LCD, the amount of electric charges in the liquid crystal capacitor is minimum, and when black appears on the LCD, the amount of electric charges in the liquid crystal capacitor is maximum.

A drop of the common electrode voltage caused by the resistance changes in an electrode due to the difference in the amount of charges flowing through the common electrode, the voltage difference between both terminals of liquid crystal capacitor of horizontally contiguous pixels come to be different with the voltage difference between both terminals of liquid crystal capacitor of vertically contiguous pixels. This induces the distortion of a common electrode voltage waveform, as shown in FIG. 5. The gray level is displayed by applying charges proportional to an area C and an area D of FIG. 5. Then, because the difference between the area C and the area D is big, charges of the liquid crystal capacitor when a minus voltage is applied to the liquid crystal and charges of the liquid crystal capacitor when a plus voltage is applied to the liquid crystal become different, which degrades the precise display.

In other words, there occurs a difference in voltages applied to the liquid crystal although the same color is displayed on the LCD due to the distortion of the common electrode voltage waveform, causing crosstalk due to changes in the transmittance of the liquid crystal layer.

SUMMARY OF THE INVENTION

It is therefore an object of the present invention to prevent LCD's crosstalk.

The LCD of the present invention comprises a liquid crystal display panel, a gate driver, a gray voltage generator, a source driver, a common electrode voltage generator, and a compensator for a distortion of common electrode voltage. A plurality of thin film transistors, a plurality of gate lines connected to gate electrodes of the thin film transistors, and a plurality of data lines connected to source lines of the thin film transistors are formed on the panel. The gate driver applies a gate signal through the gate lines of the panel and turns on and turns off the TFTs. The gray voltage generator generates gray voltages that have many voltage levels. The data driver applies to the data lines a data voltage for displaying picture signals on the liquid crystal display. The common electrode voltage generator generates a common electrode voltage applied to a common electrode of the panel. The compensator for a distortion of common electrode voltage is connected between the panel and the gray voltage generator and compensates for the distortion of common electrode voltage by changing the gray voltage.

The gray voltage generator comprises a plurality of resistors that is serially connected between a voltage source and a ground terminal, and divides the voltage of the voltage source, to generate a plurality of gray voltages of different voltage levels.

The compensator for a distortion of common electrode voltage comprises a capacitor that is connected between the common electrode of the liquid crystal display panel and the data voltage generator.

The compensator for a distortion of common electrode voltage may further comprise an amplifier that is connected between the common electrode of the panel and the capacitor, amplifying the distorted common electrode voltage to compensate for the distorted common electrode voltage measured at the common electrode of the liquid crystal capacitor.

DETAILED DESCRIPTION OF THE PREFERRED EMBODIMENTS

A preferred embodiment of the present invention will now be described more fully hereinafter with reference to the accompanying drawings.

Figures 1, 2:
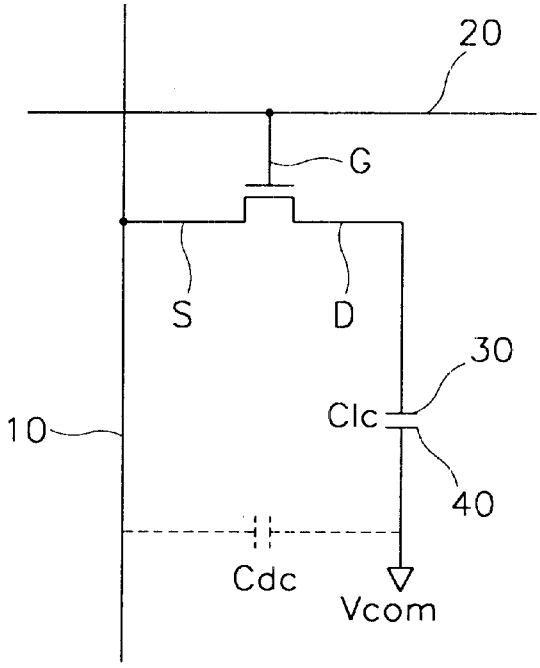
FIG. 1 (Prior Art)
FIG. 1 shows an equivalent circuit of a unit pixel in the conventional LCD.
FIG. 2 shows a charged voltage of each unit pixel in the LCD using the dot inversion driving method.
Figure 3:
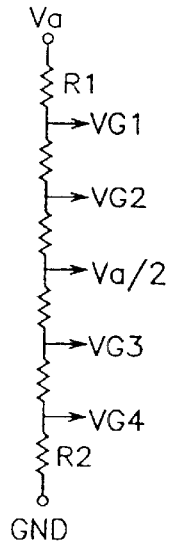
FIG. 3(Prior Art)
FIG. 3 is a schematic view of a gray voltage generating circuit in the conventional TFT-LCD driving circuit using a resistor string.
Figure 4:
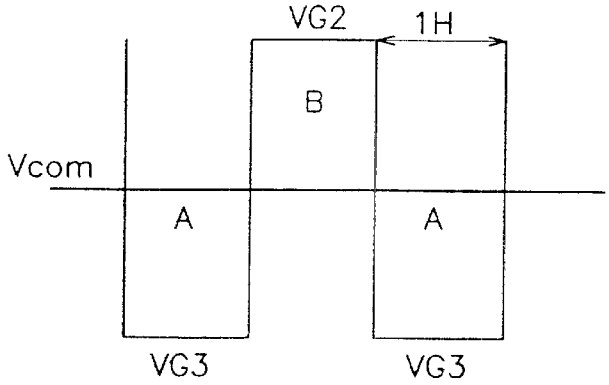
FIG. 4 is a schematic view of common electrode voltage and gray voltage applied to the LCD when no crosstalk phenomenon occurs in the dot inversion driving method.
Figure 5:
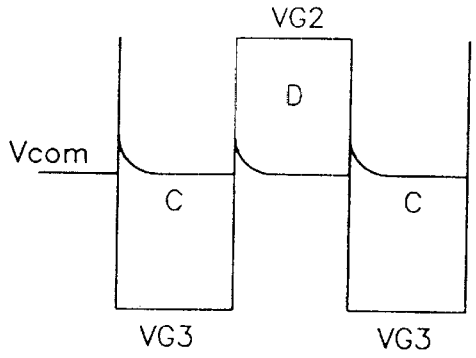
FIG. 5 is a schematic view of the common electrode voltage and gray voltage applied to the LCD when a crosstalk phenomenon occurs in the dot inversion driving method.
Figure 6:
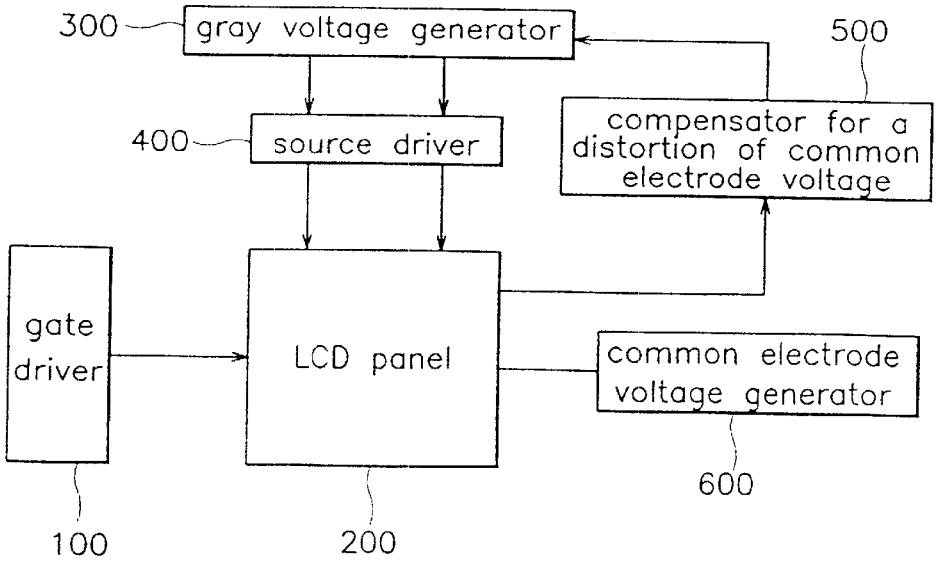
FIG. 6 shows the LCD in accordance with the present invention.

FIG. 6 shows an LCD in accordance with the first embodiment of the present invention.

The LCD in accordance with the first embodiment of the present invention comprises an LCD panel 200, a gate driver 100, a gray voltage generator 300, a source driver 400, a compensator for a distortion of common electrode voltage 500, and a common electrode generator 600.

A plurality of gate lines, a plurality of data lines crossing the gate lines, and a plurality of thin film transistors are formed on the panel 200. The gate driver 100 is connected to the gate lines of the panel 200 and turns on the TFT to transfer the gray voltage from the source driver 400 to the pixels. The gray voltage generator 300 generates gray voltages that is applied to the pixel electrode and represents gray levels displayed on the panel 200. The source driver 400 applies the gray voltage of the gray voltage generator 300 to the data lines of the LCD panel 200. The common electrode voltage generator 600 generates a common electrode voltage applied to a common electrode of the LCD panel 200. The compensator for a distortion of common electrode voltage 500 is connected between the LCD panel 200 and the gray voltage generator 300, and compensates for the distortion of common electrode voltage.

Figure 7:
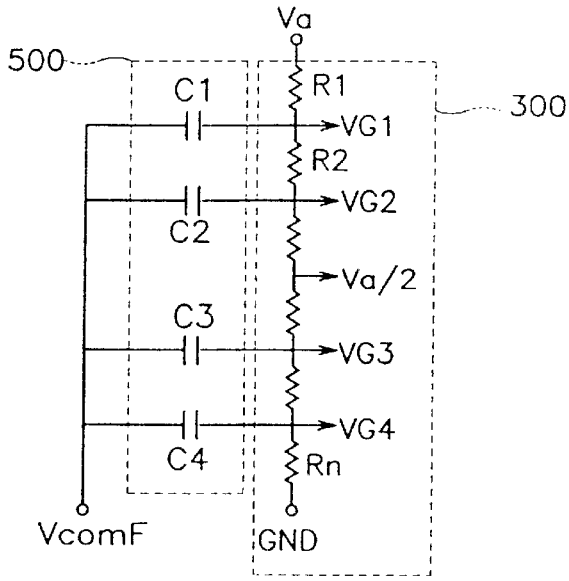
FIG. 7 is a detailed illustration of the gray voltage generator and the compensator for the distortion of common electrode voltage in accordance with the first embodiment of the present invention.

FIG. 7 is a detailed figure of the data voltage generator and the compensator for the distortion of common electrode voltage in accordance with the first embodiment of the present invention.

Figure 8:
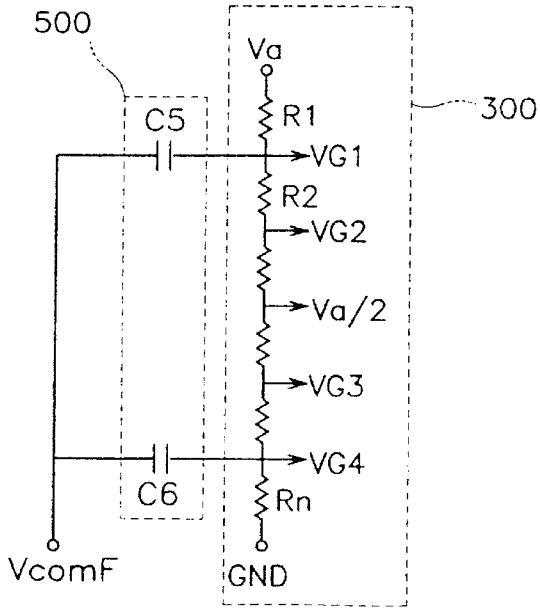
FIG. 8 is one example modifying the circuit of FIG. 7.

FIG. 8 is one example modifying the circuit of FIG. 7.

Figure 9:
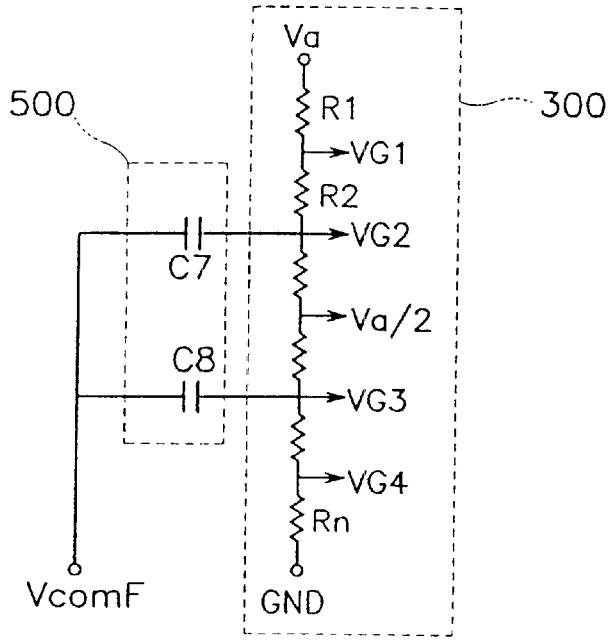
FIG. 9 is another example modifying the circuit of FIG. 7.

FIG. 9 is another example modifying the circuit of FIG. 7.

The gray voltage generator 300 comprises a plurality of resistors R1, R2, . . . , Rn that are serially connected between a voltage source Va and ground and divides the voltage source voltage Va by the resistors R1, R2, . . . , Rn and outputs the divided voltages through terminals provided between the resistors R1, R2, . . . , Rn. The number of the resistors may change if necessary.

The compensator for a distortion of common electrode voltage 500 comprises a plurality of capacitors C1, C2, C3, C4, which are connected between the common electrode of the LCD panel 200 and the output terminals of the gray voltages. The capacitors may be connected to all of the gray voltage output terminals or may be connected to some of the gray voltages output terminals.

For example, as shown in FIG. 8 and FIG. 9, capacitors may be connected to the gray voltage output terminal that has the biggest difference from the common electrode voltage Vcom and the gray voltage output terminal that has the second biggest difference from the common electrode voltage Vcom.

The operation of the first embodiment of the present invention will be explained hereinafter referring to the drawings.

Figure 10:
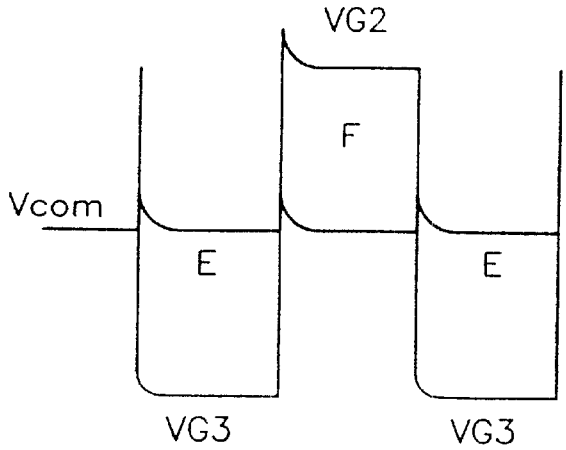
FIG. 10 shows the waveform of common electrode voltage and data voltage applied to the LCD panel in accordance with the first embodiment of the present invention.

FIG. 10 shows a waveform of common electrode voltage and gray voltage applied to the LCD panel in accordance with the first embodiment of the present invention.

The LCD in accordance with the first embodiment modifies the waveform of the gray voltage to solve the crosstalk phenomenon caused by the distortion of the common electrode voltage. That is, a voltage error of the liquid crystal capacitor Clc can be diminished by modifying the waveform of the gray voltage to be the same as the waveform of the distorted common electrode voltage, thereby preventing the crosstalk phenomenon.

Detailed operations of the LCD of the first embodiment are as follows. The capacitors C1, C2, C3, C4 are connected between the common electrode 40 of the LCD panel 200 and the gray voltage output terminal of the gray voltage generator 300. Since a capacitor inherently changes its charges continuously, the voltage waveform of the output terminal of the data voltage generator 300 become similar to the voltage waveform of the common electrode by mirroring the voltage waveform of the common electrode voltage, as shown in FIG. 10. Accordingly, the area of a region F when a plus voltage is applied to the liquid crystal goes the same as the area of a region E when a minus voltage is applied to the liquid crystal. The charges of the liquid crystal capacitor Clc when a plus voltage is applied to the liquid crystal become the same as the charges of the liquid crystal capacitor Clc when a minus voltage is applied to the liquid crystal, preventing the crosstalk by controlling the capacitance of the capacitor appropriately.

It is preferable that a time constant of the waveform of the gray voltage by the resistor R and C in the gray voltage generator 300 is bigger than the horizontal synchronization period to mirror the distorted waveform of the common electrode voltage into the waveform of the gray voltage. That is, the relation of $R \times C >> 1H$ exists. Accordingly, it is preferable that the capacitance of the capacitor connected to the gray voltage output terminals is bigger than the value of the horizontal synchronization period (1H) divided by the resistor R.

A second embodiment of the present invention will be explained hereinafter referring to the drawings.

An LCD in accordance with the second embodiment of the present invention has the same structure as the first embodiment of the present invention except for the compensator for a distortion of common electrode voltage.

Figure 11:
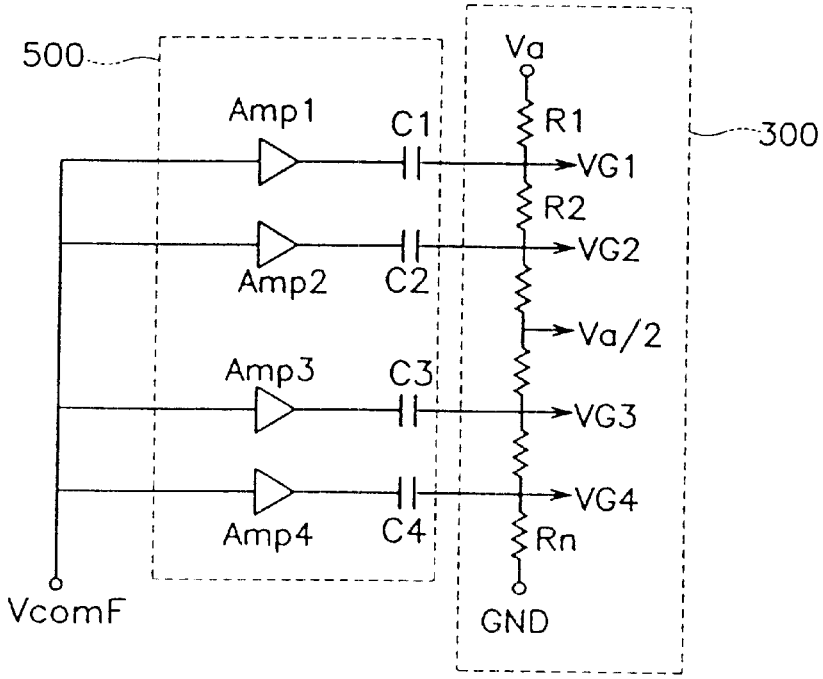
FIG. 11 shows the gray voltage generator and the compensator for the distortion of common electrode voltage in accordance with the second embodiment of the present invention.

FIG. 11 shows a data voltage generator and a compensator for the distortion of common electrode voltage in accordance with the second embodiment of the present invention.

The compensator for the distortion of common electrode voltage 500 comprises a plurality of amplifiers Amp1, Amp2, Amp3, Amp4 and a plurality of capacitors C1, C2, C3, C4. The amplifiers Amp1, Amp2, Amp3, Amp4 are connected to the common electrode voltage terminals of the LCD panel 200 and the capacitors C1, C2, C3, C4 are connected to the amplifiers Amp1, Amp2, Amp3, Amp4 respectively and to the output terminals of the gray voltage generator respectively. The capacitors and the amplifiers may be connected to some of the terminals that is appropriate for compensating for the distortion of common electrode voltages. The gain of amplifiers can be controlled when it is necessary to compensate for the distortion of common electrode voltage.

The operation of the second embodiment of the present invention will be explained hereinafter referring to the drawings.

The LCD in accordance with the second embodiment of the present invention amplifies the magnitude of the distorted common electrode voltage by connecting the amplifier Amp1, Amp2, Amp3, Amp4 to the common electrode of the LCD panel 200, and gets the gray voltage to be coupled to the common electrode voltage by inputting the amplified common electrode voltage into the output terminal of the gray voltage generator 300 through capacitors. The second embodiment of the present invention can keep the crosstalk minimum by controlling the distortion ratio of the common electrode voltage through the amplifiers and can isolate unnecessary interferences between the common electrode voltage and the gray voltage from the gray voltage generator.

The crosstalk phenomenon of the LCD can be decreased by the present invention.

This invention may, however, be embodied in many different forms and should not be construed as limited to the embodiments set forth herein; rather, these embodiments are provided so that this disclosure will be thorough and complete, and will fully convey the scope of the invention to those skilled in the art.

What is claimed is:

1. A liquid crystal display comprising:

a liquid crystal panel having a plurality of thin film transistors, a plurality of gate lines connected to gate electrodes of the thin film transistors, a plurality of data lines connected to source electrodes of the thin film transistors;

a gate driver that applies a gate signal to the gate lines;

a gray voltage generator for generating a gray voltage representing image signal;

a data driver that applies to the data lines the gray voltage for displaying an image on the liquid crystal display;

a common electrode voltage generator that generates a common electrode voltage applied to the common electrode; and a compensator connected between said liquid crystal display panel and said gray voltage generator, said compensator compensating for the distortion of the common electrode voltage by modifying the gray voltage, wherein said compensator compensates for the distortion of the common electrode voltage by coupling the waveform of the gray voltage to the waveform of the common electrode voltage, and wherein said compensator comprises a capacitor connected between said common electrode and said gray voltage generator.

2. A liquid crystal display comprising:

a liquid crystal panel having a plurality of thin film transistors, a plurality of gate lines connected to gate electrodes of the thin film transistors, a plurality of data lines connected to source electrodes of the thin film transistors;

a gate driver that applies a gate signal to the gate lines;

a gray voltage generator for generating a gray voltage representing image signal;

a data driver that applies to the data lines the gray voltage for displaying an image on the liquid crystal display;

a common electrode voltage generator that generates a common electrode voltage applied to the common electrode; and a compensator connected between said liquid crystal display panel and said gray voltage generator, said compensator compensating for the distortion of the common electrode voltage by modifying the gray voltage, wherein said gray voltage generator comprises a plurality of resistors that are serially connected between a voltage source and a ground terminal, said gray voltage generator dividing the voltage of the voltage source to generate a plurality of gray voltages of different voltage levels, and wherein said compensator comprises a capacitor connected between said common electrode and said gray voltage generator.

3. A liquid crystal display comprising:

a liquid crystal panel having a plurality of thin film transistors, a plurality of gate lines connected to gate electrodes of the thin film transistors, a plurality of data lines connected to source electrodes of the thin film transistors;

a gate driver that applies a gate signal to the gate lines;

a gray voltage generator for generating a gray voltage representing image signal;

a data driver that applies to the data lines the gray voltage for displaying an image on the liquid crystal display;

a common electrode voltage generator that generates a common electrode voltage applied to the common electrode; and a compensator connected between said liquid crystal display panel and said gray voltage generator, said compensator compensating for the distortion of the common electrode voltage by modifying the gray voltage, wherein said compensator comprises a capacitor that is connected between the common electrode and said gray voltage generator.

4. The liquid crystal display of claim 3, wherein said compensator further comprises an amplifier connected between the common electrode and the capacitor, the amplifier amplifying the distorted common electrode voltage to compensate for the distorted common electrode voltage measured at the common electrode.

5. The liquid crystal display of claim 3, wherein the capacitor is connected between the common electrode and the gray voltage output terminals that are provided between resistors of said gray voltage generator.

6. The liquid crystal display of claim 5, wherein the capacitance of the capacitor is bigger than the value of the horizontal synchronization period divided by the least resistance value of the resistor in said gray voltage generator.

7. The liquid crystal display of claim 5, wherein a plurality of capacitors are connected between the common electrode and a plurality of gray voltage output terminals provided between the resistors of said gray voltage generator.

8. The liquid crystal display of claim 7, wherein the capacitor comprises:

a first capacitor connected between the common electrode and a first gray voltage output terminal of said gray voltage generator; and a second capacitor connected between the common electrode and a second gray voltage output terminal of said gray voltage generator.

9. The liquid crystal display of claim 8, wherein the first gray voltage output terminal is the output terminal of the maximum plus gray voltage and the second gray voltage output terminal is the output terminal of the maximum minus gray voltage.

10. The liquid crystal display of claim 8, wherein the first gray voltage output terminal is the output terminal of the second maximum plus gray voltage and the second gray voltage output terminal is the output terminal of the second maximum minus gray voltage.

* * * * *